United States Patent [19]

Bereiter

[11] Patent Number: 5,056,701

[45] Date of Patent: Oct. 15, 1991

[54] EXPLOSIVE POWDER CHARGE OPERATED FASTENING ELEMENT SETTING TOOL

[75] Inventor: Rolf Bereiter, Grabs, Switzerland

[73] Assignee: Hilti Aktiengesellschaft, Furstentum, Liechtenstein

[21] Appl. No.: 557,938

[22] Filed: Jul. 26, 1990

[30] Foreign Application Priority Data

Jul. 26, 1989 [DE] Fed. Rep. of Germany ..... 3924620

[51] Int. Cl.[5] ..... B25C 1/04

[52] U.S. Cl. ..... 227/10; 173/139

[58] Field of Search ..... 227/9, 10, 11; 173/139

[56] References Cited

U.S. PATENT DOCUMENTS

| | | | |
|---|---|---|---|
| 3,212,535 | 10/1965 | Broske | 227/10 |
| 4,222,462 | 9/1980 | Ottestad | 173/139 |
| 4,492,329 | 1/1985 | Benson et al. | 227/10 |
| 4,609,135 | 9/1986 | Elliesen | 173/139 |
| 4,824,003 | 4/1989 | Almeras et al. | 227/10 |

*Primary Examiner*—Hien H. Phan
*Assistant Examiner*—Raymond D. Woods
*Attorney, Agent, or Firm*—Toren, McGeady & Associates

[57] ABSTRACT

An explosive powder charge operated fastening element setting tool includes an interceptor (14) for intercepting or cushioning a driving piston (8) in the event excess energy is supplied to the piston in driving a fastening element into a receiving material. The driving piston (8) has a shoulder (12*a*) displaceable when excess energy is present into the axially extending region of a deformable stopper (27) in contact with a bolt guide (4). If the interceptor (14) for the driving piston (8) does not afford an adequate braking, the shoulder (12*a*) runs up against the stopper (27) and the stopper is deformed and tightly clamps or jams the driving piston (8) so that it can not be freely displaced. When such jamming action takes place, the tool operator is signaled that a buffer (23) between the interceptor and the bolt guide and possibly the stopper (27) need to be replaced.

9 Claims, 3 Drawing Sheets

EXPLOSIVE POWDER CHARGE OPERATED FASTENING ELEMENT SETTING TOOL

BACKGROUND OF THE INVENTION

The present invention is directed to an explosive powder charge operated fastening element driving or setting tool with a driving piston having a head at its trailing end and a shaft or shank extending from the head to the leading end. A bolt guide is located at the leading end of the tool and has a bore corresponding essentially to the diameter of the driving piston shank. An interceptor for holding or cushioning the driving piston while overcoming a predetermined advancing travel in the driving direction of the piston includes a plastically deformable stopper.

An explosive powder charge operated fastening element setting tool is disclosed in EP-A-O 274 919 and includes an arrangement for braking the driving piston in the event there is excess driving energy. The arrangement involves an elastically deformable buffer and a plastically deformable stopper between an intercepting device for the driving piston and a bolt guide. The disadvantage of this known setting tool, in spite of the plastic deformation of the stopper after failure of the elastic buffer because of fatigue or extrusion, is that the tool still appears to be functional to the operator though the braking arrangement can no longer supply the entire braking effect. As a result, there is the danger that existing excess energy acting on the driving piston can not be adequately absorbed and penetration of the fastening element in such receiving materials are characterized by a small penetration resistance.

SUMMARY OF THE INVENTION

Therefore, it is the primary object of the present invention to provide a fastening element setting tool with a braking device for the driving piston where the operability of the device is instantaneously recognizable by the operator.

In accordance with the present invention, the plastically deformable stopper abuts in the driving direction against a bolt guide and the driving piston has a shoulder arranged to project into the stopper, so that the distance extending in the driving direction between the shoulder and the stopper corresponds at the most to the advancing travel of the driving piston in contact with the interceptor. The advancing travel is determined by the interceptor. Should excess energy develop, the driving piston impacts on the interceptor and is braked while overcoming the predetermined advancing travel.

One possibility of the braking effect is that the piston along with the interceptor moves for the predetermined advancing travel, and, as a result, the interceptor abuts the bolt guide through an elastic buffer. Accordingly, the excess energy is absorbed by the deformation of the elastic buffer. As a consequence, due to the extrusion, the volume of the elastic buffer diminishes toward the end of its useful life. Therefore, the leading end position of the driving piston is displaced in the driving direction in such a way that after absorption of the excess energy, the shoulder on the piston impacts against the stopper. Such impacting of the shoulder has the effect that the stopper is plastically deformed and tightly jams the driving piston and provides a signal to the tool operator that the elastic buffer has reached the end of its useful life and should be replaced along with the stopper.

In another embodiment for effecting braking, the interceptor abuts directly against the bolt guide, and the predetermined advancing travel resulting in the braking of the driving piston is only provided by the piston. In this arrangement, the absorption of the excess energy occurs through changing the shape of the interceptor against a counter force of spring elements. By varying the dimensions of the spring elements it is possible to control the excess energy to be absorbed. If for example, due to incorrect dimensioning, the excess energy is not completely absorbed by the interceptor, the shoulder on the driving piston impacts against the stopper, resulting in a plastic deformation of the stopper and a jamming of the piston. This effect affords a signal to the tool operator that the dimensions of the spring elements must be changed or the elements must be checked to determine their ability to continue to function. In addition to a replacement of the stopper it may also be necessary to replace the spring elements.

Preferably, the shoulder is formed as an annular shoulder projecting radially outwardly from the shank of the driving piston with the shoulder facing in the driving direction having a greater diameter than the shank. This type of shoulder affords a symmetrical deformation of the stopper.

In a preferred arrangement, the stopper has the shape of a hollow cylinder concentrically surrounding the shank of the driving piston, affording a uniform jamming of the piston. In an advantageous arrangement, the stopper is positioned in a recess of the bolt guide with the recess having an inside surface corresponding to the outside surface of the stopper and with an end face directed towards the shoulder on the piston. Such a recess can be located in an abutment part forming a part of the bolt guide, which can be exchanged or replaced along with the deformed stopper. The inner surface of the recess prevents a radially outward deformation of the stopper when the annular shoulder impacts against the exposed end face, whereby the plastic deformation occurs in a desired or an intended manner against the shank of the driving piston. Since the end face or base of the recess facing opposite of the driving direction tapers conically inwardly in the driving direction, a wedging effect is provided improving the jamming effect.

Metal, such as steel, is suitable as a material for the stopper.

In another embodiment of the invention, the interceptor is supported by an elastic buffer facing toward the bolt guide. The buffer is formed of a plastics material and, separate from the stopper, can be housed in a chamber for protection from mechanical interferences.

The interceptor while designed to overcome the predetermined advancing travel as well as being supported directly at the bolt guide, can be radially widenable to overcome a spring force.

An advancing interceptor is preferably arranged as a sleeve member with sections being displaceable against their intrinsic resilience. Due to the impacting of the driving piston against the interceptor with excess energy, a widening of the interceptor and with this frictional contact against a stationary tool part contacting the interceptor can be achieved. The frictional contact supports the braking effect of the elastic buffer.

An interceptor abutting directly against the bolt guide is designed advantageously as a widenable or expandable annular member surrounded by spring means. The spring means inhibit the widening of the interceptor by the driving piston and produce a braking force absorbing the excess energy. Such spring means can be formed by concentrically superimposed annular shaped spring elements.

The various features of novelty which characterize the invention are pointed out with particularity in the claims annexed to and forming a part of this disclosure. For a better understanding of the invention, its operating advantages and specific objects attained by it use, references should be had to the drawings and description matter in which there are illustrated and described preferred embodiments of the invention.

DETAILED DESCRIPTION OF THE INVENTION

Figure 1:
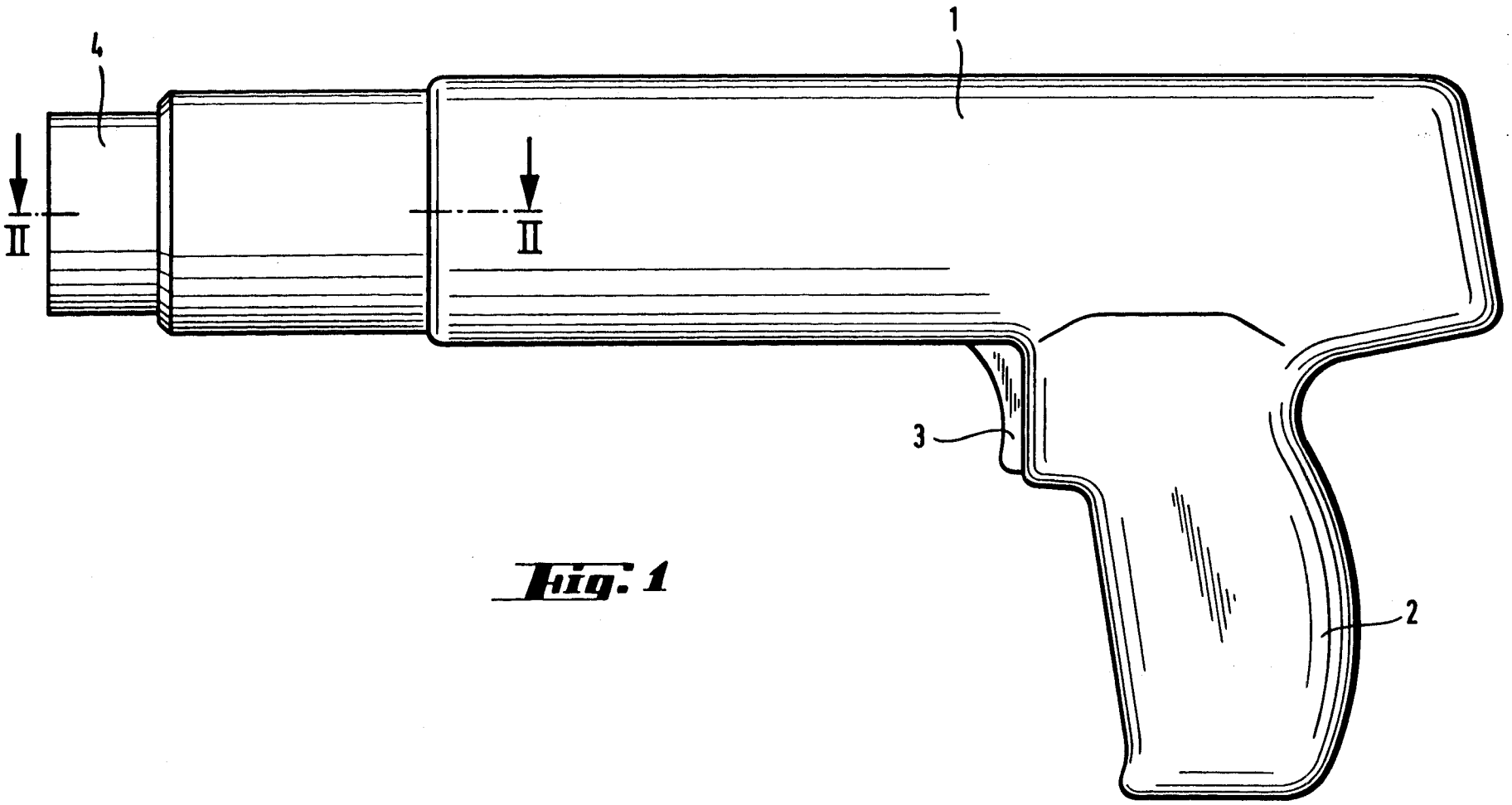
FIG. 1 is a side view of an explosive powder charge operating fastening element setting tool embodying the present invention.

In FIG. 1 a driving tool is shown for driving a fastening element from its left end, in other words, the tool has a leading end at the left end from which a fastening element is driven and a trailing end at the right end, whereby the driving direction is out of the leading end of the tool. The tool includes a housing 1 with a handle 2 extending downwardly adjacent to its trailing end. A trigger 3 is located in the handle for initiating the driving process. A bolt guide 4 extends from the leading end of the housing 1 in the driving direction.

Figure 2:
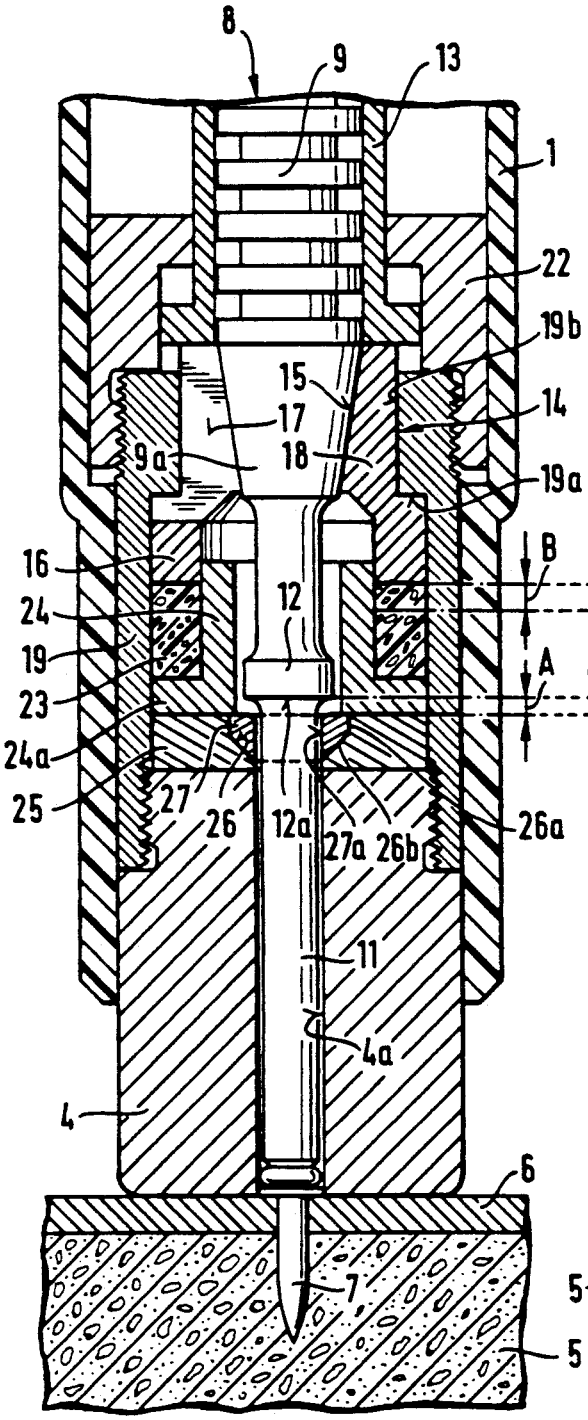
FIG. 2 is a partial enlarged sectional view of the setting tool in FIG. 1 taken along the line II—II, after a fastening element has been driven by the tool without any excess energy.

As shown in FIG. 2, the bolt guide 4 of the tool is pressed against a object 6 bearing against the surface of a receiving material 5. The object 6 is secured to the receiving material 5 by a fastening element 7, such as a bolt, stud or nail, driven through the object and into the receiving material. The fastening element 7 is driven by a driving piston 8 propelled by an explosive powder charge. Driving piston 8 is an axially elongated member extending in the driving direction with a head 9 at its trailing end and a shaft or shank 11 extending axially from the head in the driving direction. Shank 11 has a collar 12 spaced axially from the head 9 and forming an annular shoulder **12*a*** facing in the driving direction.

The head 9 of the driving piston 8 is supported in a piston guide 13 and, in the operational position displayed, the head has a conically shaped axially extending front or leading section **9*a* extending into an essentially sleeve-shaped interceptor 14 forming a corresponding conical bore 15. The interceptor 14 has a base ring 16 at its leading end with a neck extending from the base ring opposite to the driving direction subdivided by axially extending slots 17 into radially displacable sections 18. The interceptor 14 is supported radially outwardly by an axially extending tube 19 threaded at its leading end to the trailing end of the bolt guide 4 and at its trailing end into an axially extending retaining ring 22 located at the leading end of the piston guide 13. A buffer 23 of an elastic material bears against the leading end of the base ring 16 and extends from the base ring in the driving direction into contact with the trailing surface of a flange 24*a* of a sleeve 24 laterally enclosing the shank 11 rearwardly of the bolt guide 4. Buffer 23 acts with a prestress against the flange 24*a*. The prestress of the buffer 23 presses the interceptor 14 against a support shoulder 19*a* formed in the inside surface of the tube 19 closer to its trailing end. At its leading end, flange 24*a* of sleeve 24 presses against a disc-shaped abutment part 25 forming a part of the bolt guide 4. Abutment part 25 has a centrally arranged recess 26 containing a hollow cylindrically shaped stopper 27 formed of a plastically deformable material. Stopper 27, abutment part 25 and bolt guide 4 are penetrated by the shank 11 of the driving piston 8 with the shank 11 extending through a central bore 27*a* in the stopper 27 and a bore 4*a* in the bolt guide 4. As viewed in FIG. 2., the annular shoulder 12*a* of the collar 12 is located spaced rearwardly from the stopper 27 and the annular shoulder projects radially outwardly from the inside diameter of the central bore 27*a*. Stopper 27 has an outer surface bearing against the inner surface 26*a* of the recess 26. Further, recess 26 has a conically shaped base 26*b* extending in the driving direction from the cylindrically shaped inside surface 26*a***.

Figure 3:
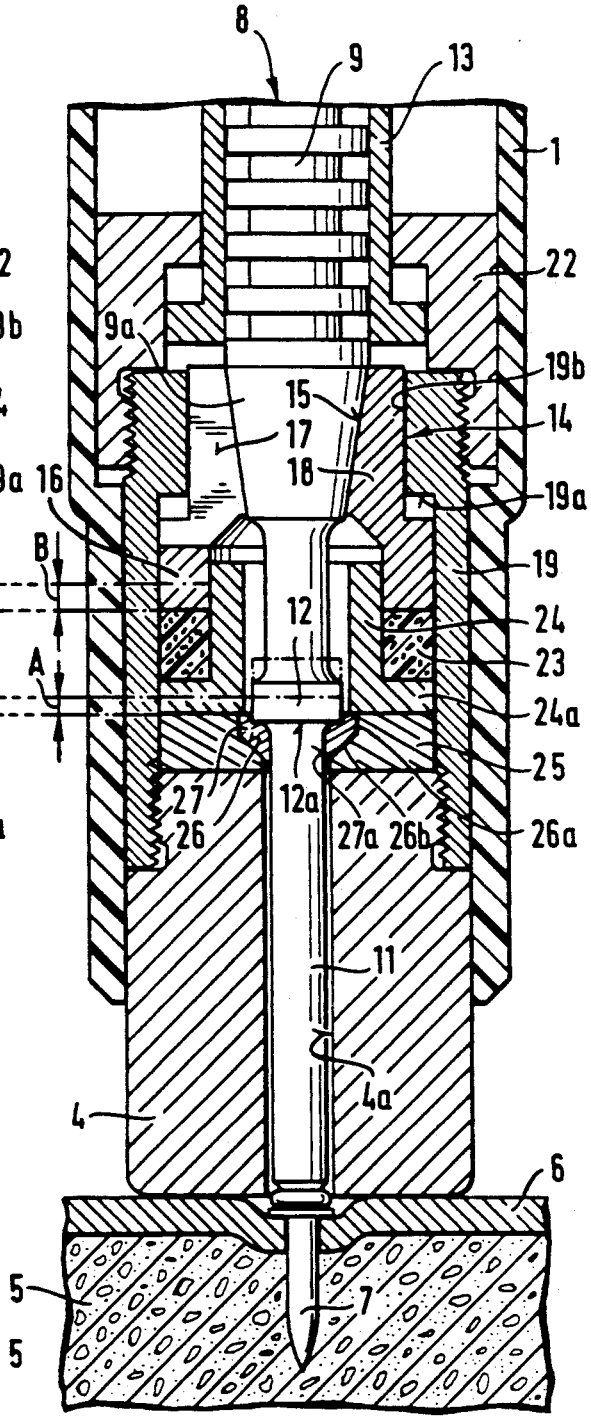
FIG. 3 is a sectional view similar to FIG. 2, however, after a fastening element has been driven with excess energy and with an ineffective buffer.

As mentioned above, FIG. 2 shows a fastening element 7 driven into the receiving material 5 without any excess energy. In FIG. 3, however, excess energy is present with the fastening element 7 forcing a section of the object 6 into the surface of the receiving material 5. Accordingly, if such excess energy is present, possibly as a result of insufficient penetration resistance of the receiving material 5, the driving piston continuing to move in the driving direction has the conical front or leading section **9*a* of the head 9 pressed into the interceptor 14 with the elastic buffer 23 being deformed in the driving direction; compare FIGS. 2 and 3. The sections 18 are pressed against the inside surface 19*b* of the tube 19 at the commencement of the passage of the front or leading section 9*a* into the interceptor while overcoming the intrinsic resilience of the sections 18, whereby the interceptor is displaced and a high braking effect is developed, because of the frictional contact between the interceptor 14 and the tube 19**.

In FIG. 3 the position of the interceptor 14 and the driving piston 8 can be noted after they have traversed an advancing travel B equal to or greater than the distance A between the stopper 27 and the annular shoulder **12*a* upon impact of the head 9 against the interceptor; note FIG. 2. The driving piston 8 moves for the entire advancing travel B if the buffer 23 is at the end of its useful life and the braking effect is no longer adequate. Accordingly, annular shoulder 12*a* on the shank of the piston runs up into the axial range of and against the trailing end of the stopper 27, and the stopper is plastically deformed towards the shank 11 and tightly jams the shank. As a result, the tool operator notices, because of the inability of the driving piston 8 to return or rebound, that buffer 23 and stopper 27 must be replaced. The replacement of the stopper 27 can be effected together with the abutment part 25**.

Figure 4:
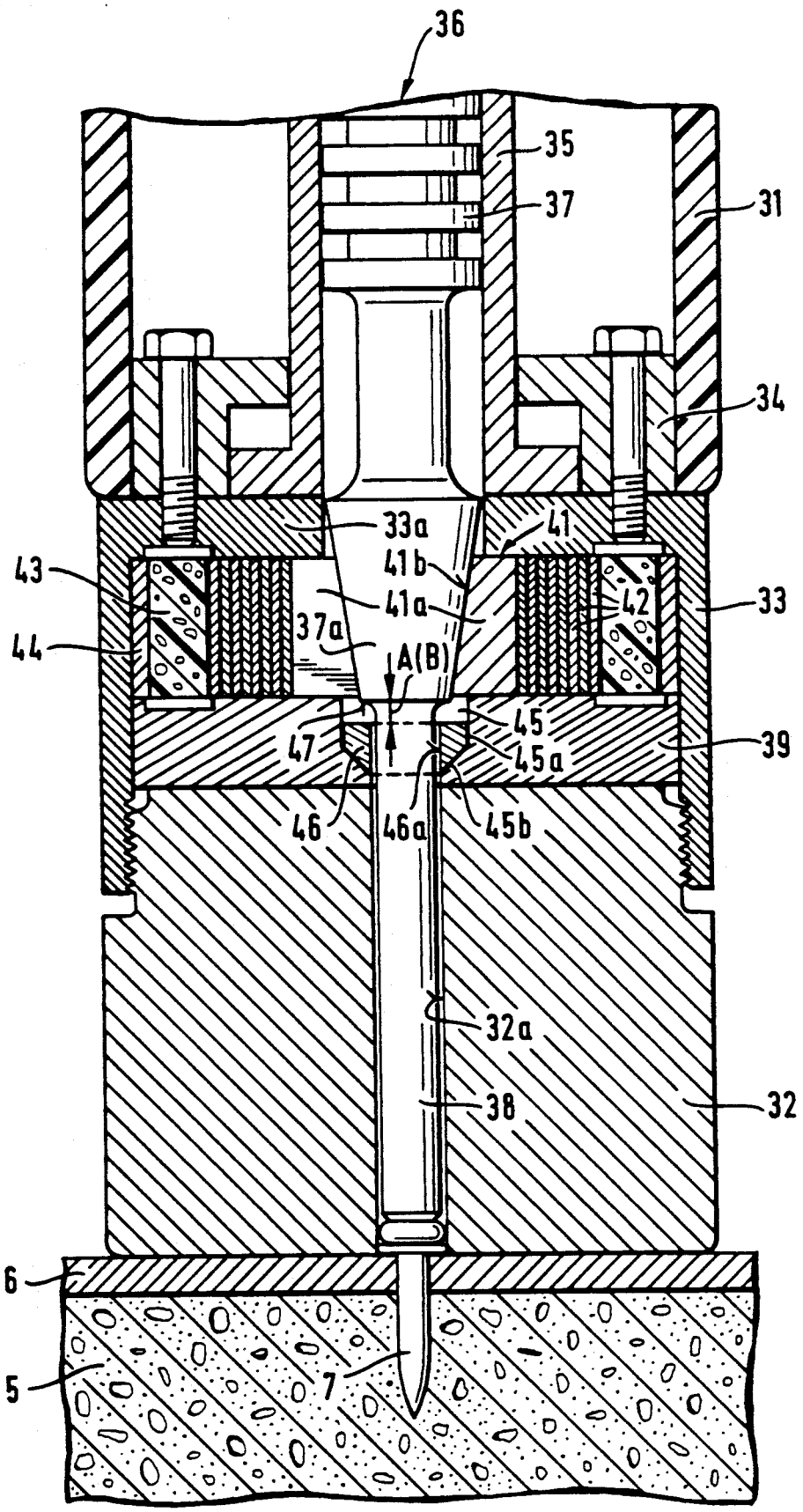
FIG. 4 is a sectional view similar to FIGS. 2 and 3, however, on a still larger scale illustrating a fastening element driven without excess energy.

In another embodiment shown in FIG. 4, the driving tool has an axially extending housing 31, and a bolt guide 32 spaced from the leading end of the housing by a tube 33. Tube 33 is threaded onto a axially extending trailing end section of the bolt guide 32. A retaining ring 34 is secured to the trailing end of the tube 33 and extends into the leading end of the housing 31. A piston guide 35 extends through the retaining ring 34 into contact with the trailing end of the tube 33. Driving piston 36 is axially displaceably supported with its head 37 in the piston guide 35 and with its shank 38 extending in the driving direction from the head through a bore 32*a* in the bolt guide 32. An interceptor 41 is held so that it is not axially displaceable between a trailing end base part 33*a* of the tube 33 and a plate-shape abutment part 39 of the bolt guide 32. Interceptor 41 is made up of annular sectors 41*a* each with a conically shaped inside surface 41*b* tapering inwardly in the driving direction. The sectors 41*a* combine to form an annulus. A conically shaped front section 37*a* of the head 37 corresponds to the conically shaped inside surface 41*b* and contacts this inside surface. Sectors 41*a* are held together by concentrically arranged annular shaped spring elements 42 offset with respect to one another in the circumferential direction. An elastic ring 43 laterally encircles and exerts a prestressing force on the spring elements 42. A sleeve 44 encircles the elastic ring 43, whereby the sleeve 44, the interceptor 41, the spring elements 42 and the elastic ring 43 make up a unit.

A recess 45 is formed in the trailing end surface of abutment part 39 and the recess has a cylindrically shaped inside surface 45*a* and a conically shaped base 45*b* extending inwardly from the inside surface in the driving direction. Recess 45 holds a stopper 46 formed of plastics material. Shank 38 extends through a central bore 46*a* in the stopper 46 and through a bore 32*a* in the bolt guide 32. The transition from the shank 38 to the front section 37*a* of the head 37 forms an annular shoulder 47 having an outside diameter extending radially outwardly beyond the inside surface of the central bore 46*a* of the stopper 46.

In FIG. 4 the driving piston 36 is shown impacting against the interceptor 41 with a prescribed driving depth B of a fastening element 7 similar to FIG. 2. If, however, excess energy is present, then the conically shaped leading end section 37*a* of the driving piston 36 moves axially into the stationary interceptor 41 and expands the interceptor against the force of the spring elements 42 and the elastic ring 43. If the force exerted by the spring elements 42 should be insufficient, the annular shoulder 47 of the driving piston 36 impacts against the stopper 46 and plastically deforms the stopper, whereby the driving piston is jammed or tightly clamped. As in the embodiment of FIGS. 2 and 3, the tool operator becomes aware of this situation so that the quantity or dimensions of the spring elements must be changed or the correct functioning checked. The deformed stopper must be replaced.

While specific embodiments of the invention have been shown and described in detail to illustrate the application of the inventive principles, it will be understood that the invention may be embodied otherwise without departing from such principles.

I claim:

1. Explosive powder charge operated fastening element setting tool having a leading end from which the fastening elements are driven in a driving direction and a trailing end, said tool comprising a driving piston (8, 36) including a head (9, 37) and a shank (11, 38) extending in the driving direction from the head, a bolt guide (4, 32) having an axially extending bore (4*a*, 32*a*) located at the leading end of the tool with the bore having a diameter substantially the same as the diameter of said shank (11, 38), and arranged to receive said shank when said driving piston is driven, an annular interceptor (14, 41) encircling said shank and located along the path of travel of said driving piston (8, 36) in the driving direction for intercepting or cushioning the driving piston while overcoming a predetermined advancing travel (B) of the piston in the driving direction, said head (9, 37) having an axially extending frusto-conically shaped section (9*a*, 37*a*) adjoining a trailing end of said shank and said interceptor having a axially extending frusto-conically shaped bore having a shape corresponding to said frusto-conically shaped section, said driving piston (8, 36) being axially displaceable into contact with said interceptor (14, 41) and a plastically deformable stopper (27, 46), wherein the improvement comprises said stopper is spaced in the driving direction from said interceptor, said interceptor has an axially extending inner surface arranged to be contacted by said frusto-conically shaped section and an axially extending outer surface, means laterally enclosing the axially extending outer surface of said interceptor, elastic buffer means arranged to deform gradually as said frusto-conically shaped section contacts and radially displaces said interceptor as said driving piston moves an umber of times in the driving direction, said plastically deformable stopper (27, 46) abuts in the driving direction against said bolt guide (4, 32), said driving piston (8, 36) comprises a shoulder (12*a*, 47) projecting radially outwardly from said shank and spaced axially from said frusto-conically shaped section, said shoulder being axially displaceable into an axial range of said stopper (27, 46) as said elastic buffer means deforms, said driving piston when driven having a first position wherein said shoulder (12*a*, 47) is spaced axially from said stopper (27, 46) by a distance (A) and a second position where said shoulder contacts and plastically deforms said stopper following the deformation of said elastic buffer means and the distance (A) corresponds at most to the advancing travel predetermined by the interceptor (14, 41) so that said stopper jams the shank of said piston and prevents the piston to return to a driving position.

2. Explosive powder charge operated fastening element setting tool, as set forth in claim 1, wherein said shoulder (12*a*, 47) is an annular shoulder facing in the driving direction.

3. Explosive powder charge operated fastening element setting tool, as set forth in claim 2, wherein said stopper (27, 46) comprises a hollow cylinder concentrically encircling said shank (11, 28) of said driving piston (9, 36).

4. Explosive powder charge operated fastening element setting tool, as set forth in claim 3, wherein said bolt guide (4, 32) has a recess (26, 45) in an end thereof facing counter to the driving direction and said stopper (27, 46) positioned within said recess, and said recess having an inside surface (26*a*, 45*a*), corresponding to and contacting an outer surface of said stopper (27, 46) and having a base facing toward said annular shoulder (12*a*, 47) of said driving piston (8, 36).

5. Explosive powder charge operated fastening element setting tool, as set forth in claim 4, wherein said base of said recess (26, 45) is conically shaped tapering inwardly toward said shank in the driving direction.

6. Explosive powder charge operated fastening element setting tool, as set forth in claim 1, wherein said elastic buffer means comprises an annular elastic buffer (23) laterally encircling said driving piston and located between said frusto-conically shaped section (9*a*, (37*a*) and said bolt guide (4).

7. Explosive powder charge operated fastening element setting tool, as set forth in claim 6, wherein said interceptor (14, 41) is radially expandable against a spring force.

8. Explosive powder charge operated fastening element setting tool, as set forth in claim 7, wherein said interceptor (14) comprises an axially extending sleeve member comprising an annular base (16) at a leading end thereof and individual sections (18) extending from said base opposite to the driving direction and being radially outwardly displaceable against their intrinsic resilience as said frusto-conically shaped section moves in the driving direction relative to said interceptor.

9. Explosive powder charge operated fastening element setting tool, as set forth in claim 7, wherein said interceptor (41) comprises an axially extending radially outwardly expandable annular member laterally enclosed by spring means (42, 43).

* * * * *